United States Patent [19]

Nakagawa et al.

[11] 3,982,513

[45] Sept. 28, 1976

[54] CARBURETOR FOR TORCH IGNITED ENGINE

[75] Inventors: Yasuhiko Nakagawa, Fujisawa; Meroji Nakai, Yokohama, both of Japan

[73] Assignee: Nissan Motor Co., Ltd., Yokohama, Japan

[22] Filed: May 3, 1974

[21] Appl. No.: 466,880

[30] Foreign Application Priority Data

May 7, 1973 Japan ..... 48-50479

[52] U.S. Cl. ..... 123/119 D; 123/97 B; 123/124 R; 261/DIG. 19

[51] Int. Cl.[2] ..... F02B 33/00

[58] Field of Search ..... 123/32 SP, 32 ST, 97 B, 123/75 B, 119 D, 124 R; 137/480; 261/DIG. 19

[56] References Cited

UNITED STATES PATENTS

| | | | |
|---|---|---|---|
| 3,092,088 | 6/1963 | Goossak et al. | 123/75 B |
| 3,675,632 | 7/1972 | Nakajima | 123/119 D |
| 3,677,526 | 7/1972 | Pierlot | 261/DIG. 19 |
| 3,698,371 | 10/1972 | Mitsuyama | 123/127 |
| 3,742,922 | 7/1973 | Hisatomi | 261/DIG. 19 |

FOREIGN PATENTS OR APPLICATIONS

| | | | |
|---|---|---|---|
| 1,916,639 | 4/1969 | Germany | 261/DIG. 19 |

*Primary Examiner*—Charles J. Myhre
*Assistant Examiner*—James D. Liles

[57] ABSTRACT

An auxiliary air intake passageway provided with a fuel jet opens into the main barrel between the main throttle and the intake manifold. A valve permits auxiliary air-fuel mixture to flow into the main barrel through the air intake passageway when the vacuum in the intake manifold exceeds a certain value during deceleration of the vehicle. The auxiliary mixture supply prevents excessive reduction of the exhaust gas temperature and resulting emission of unburned pollutants.

3 Claims, 3 Drawing Figures

CARBURETOR FOR TORCH IGNITED ENGINE

The present invention generally relates to a motor vehicle carburetor, and more particularly to a carburetor for a torch ignited gasoline engine, having means to continue adequate air-fuel mixture supply during deceleration of a motor vehicle.

Torch ignited engines are now attracting public attention as a promising answer to the problem of preventing pollutants emission from gasoline engines. In this type of engine, are provided a small antechamber for producing torch flame utilizing a relatively rich air-fuel mixture, and a main combustion chamber in which an extremely lean air-fuel mixture is ignited by the torch flame to allow long-lasting and complete combustion. The rich and lean mixtures for the respective chambers are usually prepared separately in a carburetor having two barrels, each of which include a venturi and a throttle valve.

It has been proven that the exhaust gas from such an engine is remarkably cleaner than that from conventional engines, but it is another fact that the clean exhaust has been so far generated only when the engine is in normal operation. One of the important technical problems yet unsolved with torch ignited engines is a considerable temperature reduction of the exhaust gas occurring when the vehicle is decelerated by means of engine braking.

The exhaust gas temperature of a torch ignited engine goes down as the load on the engine decreases, and the load becomes smallest during engine braking except during idling. As a result, the exhaust gas temperature becomes so low that a considerable amount of unburned hydrocarbons (HC) and carbon monoxide (CO) are discharged. The reason for such temperature drop is the reduction of the intake pressure. Compared with the condition of engine idling, the intake vacuum is far higher during engine braking, because of the engine speed is much higher while the opening of the main throttle is identical. For example, the intake pressure in such an engine is −520 mmHg during idling at 700 rpm, but becomes −622 mmHg during engine braking at 2400 rpm. Such a great vacuum naturally causes the air-fuel charging efficiency to be lowered and results in the exhaust gas temperature reduction.

It is therefore an object of the present invention to provide a carburetor for a torch ignited engine, having means to prevent the intake pressure from being reduced to such an extent during engine braking as to lead to an excessive reduction in the exhaust gas temperature.

In a carburetor for a torch ignited engine, the improvement according to the invention comprises:

an auxiliary passageway communicating with the atmosphere and opening into the main barrel of the carburetor downstream of a main throttle valve;

an auxiliary fuel jet communicating with the float chamber of the carburetor and opening into the auxiliary passageway; and a valve disposed in the auxiliary passageway between the auxiliary fuel jet and the main barrel, the valve being normally closed and adapted to open when the magnitude of the negative gage pressure in an engine intake manifold exceeds a predetermined value so that an auxiliary air-fuel mixture may be drawn into the main barrel through the auxiliary passageway.

Other features and advantages of the invention will become clear from the following detailed description of a preferred embodiment thereof with reference to the accompanying drawings, in which.

Figure 1:
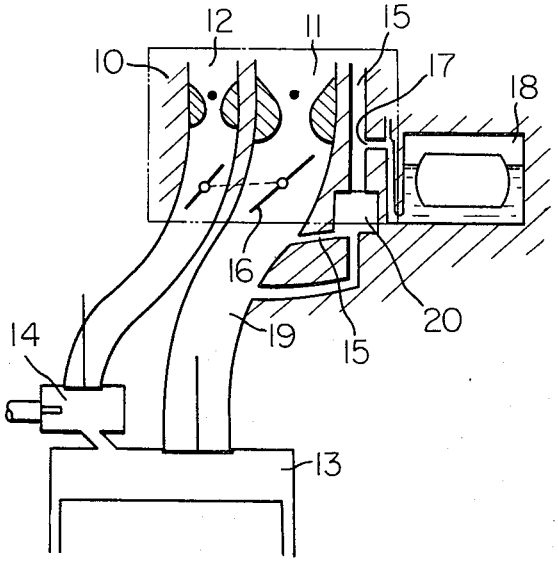
FIG. 1 is a schematic diagram of the carburetor according to the invention, combined with a combustion chamber of a torch ignited engine.

Referring to FIG. 1, a carburetor 10 for a torch ignited engine has a main barrel 11 and a secondary barrel 12, which have means to feed a lean, or of a high air/fuel ratio mixture into a main combustion chamber 13 and a rich mixture into an auxiliary, or antechamber 14 of the engine, respectively. According to the invention an auxiliary air intake passageway 15 for an air-fuel mixture opens into the main barrel 11 bypassing, or downstream of a main throttle valve 16. The air intake passageway 15 communicates with the atmosphere through an air intake system (not shown). An auxiliary fuel jet 17 is provided to produce an appropriate air-fuel mixture within the passageway 15 communicating with a float chamber 18, and a valve 20 governs the flow through the passageway 15. The valve 20 is communicates with an intake manifold 19 of the engine, and keeps the passageway 15 closed while the magnitude of the negative gage pressure in the intake manifold 19 is below a predetermined value. Accordingly, the passageway 15 has no influence on engine operation during normal running of the vehicle. The channel 15 may consist of a combination of pipes and/or bore holes.

Figure 2:
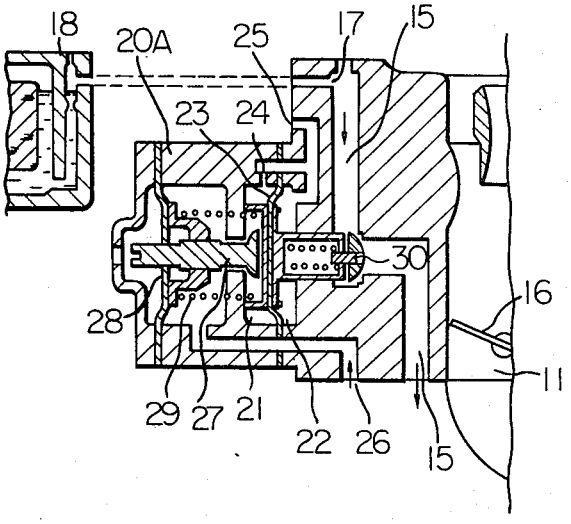
FIG. 2 is a partial sectional view of the carburetor of FIG. 1.

In a preferred embodiment of the valve 20 shown in FIG. 2, two chambers, namely, a first chamber 21 and a second chamber 22 are formed within a housing 20A. The two chambes 21, 22 are partitioned with a second diaphragm 23, but are communicated with each other through a small hole or orifice 24. The orifice 24 and hence the both chambers 21, 22 are exposed to the atmosphere through a port 25. The first chamber 21 is communicated also with the intake manifold 19 through a port 26, but the communication is normally blocked by a primary valve element 27. The valve element 27 is carried by a first diaphragm 28, and a compression spring 29 is interposed between the two diaphragms 23 and 28. A secondary valve element 30 to control the flow through the passageway 15 is fixed to the exterior surface of the second diaphragm 23.

In the above described arrangement, the first diaphragm 28 remains in a position to allow the valve element 27 to seal the first chamber 21 from the intake manifold 19 while the negative gage pressure in the manifold 19 is below a predetermined value, or while the vehicle speed is constant or increasing.

Then, the pressure in the first chamber 21 equalizes with that in the second chamber 22 due to gradual air flow through the orifice 24. Consequently, the position of the second diaphragm 23 is determined only by the force of the spring 29, so the secondary valve element 30 is pushed toward the right in FIG. 2 to close the passageway 15.

When the negative gage pressure in the manifold 19 increases during deceleration of the vehicle by means of engine braking, the first diaphragm 28 and the valve element 27 are forced to move toward the right in FIG.

2, causing the first chamber 21 to be exposed to the negative gage pressure. As a result, the second diaphragm 23 and the secondary valve element 30 are pulled toward the left, and auxiliary air-fuel mixture begins to flow into the main barrel 11 through the passageway 15. This continuation of mixture supply through the air intake passageway 15 restricts the pressure reduction in the manifold 19 to such an extent that a favorable combustion mode of the torch ignited engine is maintained. A portion of the charge taken into the main combustion chamber 13 enters the antechamber 14, so that generation of the torch flame for ignition also continues. As seen from the preliminary explanation, continuation of engine combustion with an adequate air-fuel supply leads to prevention of excessive reduction of the exhaust gas temperature, which is the direct cause of emission of unburned pollutants.

Figure 3:
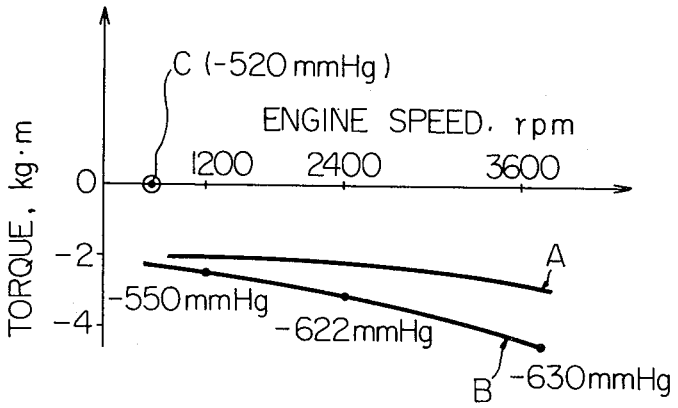
FIG. 3 is a graph showing the relationship between the engine torque and engine speed of the carburetor of FIG. 1 and a coventional carburetor.

The effect of the mixture supply according to the invention on engine combustion was confirmed by measurement of the engine torque during engine braking. In FIG. 3, the curves A and B represent the results using the carburetor 10 of FIG. 2 and a conventional carburetor, respectively. The point C represents idling. In the curve B, the negative torque becomes considerably great during engine braking, especially at high engine speed. The effect of air-fuel supply through the air intake passageway 15 on minimizing such negative torque augmentation is apparent from the curve A. The suppression of negative torque increase means improved efficiency of engine combustion and an increase in the exhaust gas temperature.

It is possible to provide another channel for the auxiliary barrel 12 similarly to the above described passageway 15 for the main barrel 11, but the effect of such an addition on the air-fuel charging efficiency is expected to be practically negligible because the air flow rate through the barrel 12 is only a few percent of that through the main barrel 11. Therefore, provision of the single passageway 15 for the main barrel 11 suffices for precluding an excessive reduction of the intake pressure. In this case, however, the air/fuel ratio in the antechamber 14 becomes larger, or leaner than during normal conditions, because of an inevitable decrease in the amount of mixture supply into the antechamber 14. Accordingly, the air/fuel ratio of the auxiliary mixture produced in the passageway 15 is preferably slightly smaller, or richer than that of the mixture through the main barrel 11, but of course leaner than the value for the auxiliary barrel 12.

What is claimed is:

1. In a combination of an internal combustion engine of the torch ignition type having a main combustion chamber and an antechamber provided with an ignition means and arranged fluidly in communication with the main combustion chamber such that a flame propagates from the antechamber to the main combustion chamber when a combustible mixture is ignited in the antechamber, and a carburetor having a main barrel provided with a main fuel jet and a main throttle valve for supplying a lean air-fuel mixture into the main combustion chamber, a secondary barrel for supplying a rich air-fuel mixture into the antechamber, and a float chamber, the improvement comprising:

an auxiliary passageway communicating with the atmosphere an opening exclusively into the main barrel downstream of the main throttle valve;

an auxiliary fuel jet communicating with the float chamber and opening into said auxiliary passageway; and a valve disposed in said auxiliary passageway between said auxiliary fuel jet and the main barrel, said valve being normally closed and adapted to open only when the magnitude of the negative gage pressure in an engine intake manifold exceeds a predetermined value, this value being reached during deceleration operation of the engine, so that an auxiliary air-fuel mixture may be drawn into the main barrel through said auxiliary passageway only during deceleration operation, in which said auxiliary air-fuel mixture is richer than said lean air-fuel mixture, so that spark-ignition in said antechamber and torch-ignition in said main combustion chamber are facilitated when said valve remains open due to fuel-enrichment of said lean air-fuel mixture which is fed to said main combustion chamber and is partly discharged into said antechamber.

2. The improvement according to claim 1, in which said valve comprises a primary valve operative with a predetermined value of negative gage pressure and a secondary valve governed by said primary valve to directly control the flow of said auxiliary air-fuel mixture through said auxiliary passageway.

3. The improvement according to claim 2, in which said primary valve comprises:

a first and a second flexible diaphragms arranged in a housing to expose a surface each thereof to the atmosphere and to define a chamber therebetween, said chamber communicating with the atmosphere and with the engine intake manifold;

a primary valve element carried by said first diaphragm and disposed in said chamber in an arrangement to prevent said second diaphragm from communicating with the intake manifold; and biasing means arranged to urge said second diaphragm to move outwardly:

and said secondary valve comprises a valve element fixed on said surface of said second diaphragm exposed to the atmosphere, so that when the magnitude of the negative gage pressure in the intake manifold exceeds a predetermined value, said first diaphragm and said primary valve element are moved to allow said second diaphragm to communicate with the intake manifold, and said second diaphragm and said secondary valve element are moved by the atmospheric pressure against the force of said biasing means.

* * * * *